US005166479A

United States Patent [19]

Gras et al.

[11] Patent Number: 5,166,479

[45] Date of Patent: Nov. 24, 1992

[54] SILENCER FOR A GAS FLOW

[75] Inventors: François N. Gras, Maurepas; Claude C. H. Friou, Adainville, both of France

[73] Assignee: Bertin & Cie, Plaisir Cedex, France

[21] Appl. No.: 571,580

[22] PCT Filed: Mar. 9, 1989

[86] PCT No.: PCT/FR89/00099

§ 371 Date: Sep. 11, 1990

§ 102(e) Date: Sep. 11, 1990

[87] PCT Pub. No.: WO89/08771

PCT Pub. Date: Sep. 21, 1989

[30] Foreign Application Priority Data

Mar. 11, 1988 [FR] France ..... 88 03183

[51] Int. Cl.[5] ..... F01N 1/24

[52] U.S. Cl. ..... 181/256; 181/258

[58] Field of Search ..... 181/224, 230, 256, 258

[56] References Cited

U.S. PATENT DOCUMENTS

| | | | |
|---|---|---|---|
| 4,113,050 | 9/1978 | Smith | 181/230 |
| 4,241,805 | 12/1980 | Chance, Jr. | 181/230 |
| 4,316,523 | 2/1982 | Boretti | 181/258 X |
| 4,375,841 | 3/1983 | Vielbig | 181/230 |
| 4,570,745 | 2/1986 | Sparks et al. | 181/230 |

*Primary Examiner*—Russell E. Adams
*Assistant Examiner*—Khanh Dang
*Attorney, Agent, or Firm*—Breiner & Breiner

[57] ABSTRACT

The silencer includes a tubular envelope supported by an end piece for fixture to a gas supply source in which the pressure is to be reduced. A perforated plate and a disk close off the ends of the envelope which is drilled with escape apertures in the region of the disk. According to the invention, the gas flows at sonic speed through the plate to enter the envelope which is completely filled with a packing consisting of a tightly wound roll of wire mesh. The packing absorbs the shock waves developed by the supersonic flow of the gas in the packing. The latter maintains a subsonic flow with a low noise level upstream of the silencer. Application to the treatment of a surface by blasting of a gas flow is also described.

8 Claims, 1 Drawing Sheet

SILENCER FOR A GAS FLOW

Figure 1:
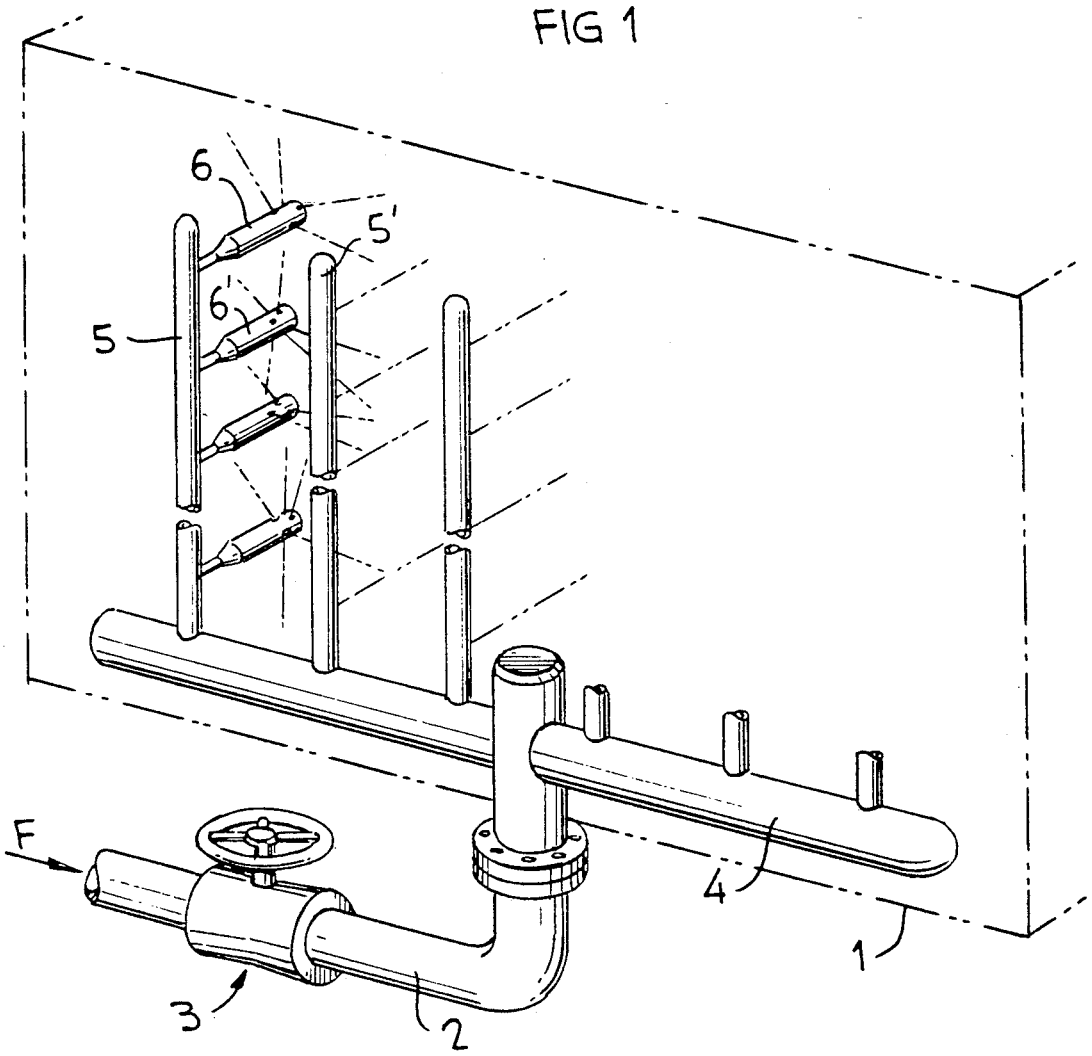

The present invention relates to an injector or ejector silencer for the expansion of a gaseous fluid and more particularly to a blowing device equipped with an assembly of such silencers or mufflers.

In many industrial uses, the expansion of a fluid, such as a gas, is an operation generating acoustic emissions which it is important to eliminate or at the very least reduce to a level considered acceptable, so as to mitigate the harmful sound effects and/or mechanical effects of these emissions. This is true especially when the object is to expand gases or vapors into the atmosphere, empty pressurized gas vessels, expand hot air to defrost the air-inlet filters of gas turbines or gas compressors, for example.

The gas or vapor injectors or ejectors employed in such uses have holes or apertures, via which the gas to be expanded enters a medium at atmospheric pressure. According to a first known arrangement, the acoustic emissions are reduced by externally covering that part of the injector or ejector having these apertures with a piece of sintered metal or of sintered plastic. This arrangement has its disadvantages. In fact, in addition to a temperature stability of the sintered pieces which can be insufficient and an increase in the overall size attributable to the external position of the sintered piece, there is the fear that, because of its low porosity, the sintered piece will be clogged by materials carried along by the gas to be expanded.

According to another known arrangement, silent expansion of the gas is obtained by arranging a more or less extensive and thick annular packing externally on an exhaust manifold, expansion chamber, throttle member or other exhaust means, and this annular packing can be produced from various materials, such as, for example, a metal wool or cloth, a glass wool or synthetic fibers, asbestos fibers, metal or wood chips and woven or knitted metal fabrics. Examples of such silent expansion devices are described in French patents nos. 1,561,483, 2,250,379, 2,372,373 and 2,498,681. It will be seen that the packings used in these examples, because of their annular shape, increase the overall size of the devices equipped with these packings, for an equal volume of acoustically absorbent packing used.

One object of the present invention is to provide an injector or ejector silencer for the expansion of a gaseous fluid, which does not have the disadvantages of clogging or of bulk of the silencers of the prior art.

Another object of the present invention is to provide such a silencer composed of simple and interchangeable standard components, so as to be suitable for inexpensive production.

Yet another object of the present invention is to provide such a silencer which takes the form of a removable cartridge easy to install or replace in a device equipped with such silencers.

These objects of the invention and others which will emerge from the rest of the description are achieved with an injector or ejector silencer for the expansion of a gaseous fluid, comprising a member for mounting the silencer on a source of this fluid and a casing having a first end covered by a throttle piece carried by this member so as to communicate internally with the fluid source, this casing having a second end distant from the first and pierced with ports for the fluid admitted into the casing to pass into an outside medium, characterized in that the throttle piece has a total orifice cross-section of a size suitable for establishing a low-speed subsonic flow of the fluid on the same side as the source and for increasing the flow of the fluid through this piece to a sonic speed, and a packing of metal wire completely filling the space within the casing from the perforated piece to the second end of this casing, with inner overlap of the ports pierced in this second end of the casing.

According to a preferred embodiment of the invention, the packing consists of a knitted fabric of metal wire in the form of a tightly wound roll.

According to other non-limiting embodiments, this packing takes the form of a woven metal fabric in the form of a tightly wound roll or of a metal sponge with open cells.

The present invention also provides a device for blowing a gaseous fluid onto an extensive surface, equipped with an assembly of silencers according to the invention, characterized in that it comprises a plurality of parallel racks mounted on a common manifold itself connected to a source of a gaseous fluid, each rack carrying a plurality of fluid injector or ejector silencers uniformly distributed and oriented in such a way that the gaseous fluid is uniformly distributed by the assembly of silencers over the entire surface to be treated by blowing.

Figure 2:
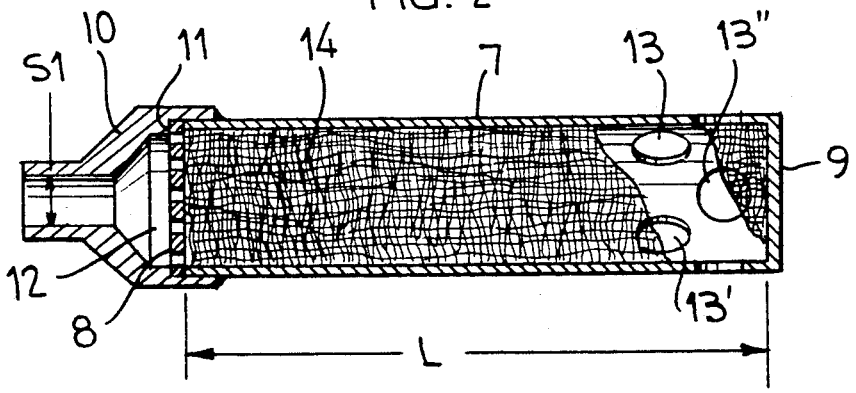

In the accompanying drawing given solely by way of example:

FIG. 1 is a perspective view of a device for blowing a gaseous fluid, equipped with an assembly of silencers according to the present invention, and FIG. 2 is a view in longitudinal section of one of the silencers according to the invention mounted on the device of FIG. 1.

The blowing device illustrated in FIG. 1 is capable of being employed in many uses, as an average person skilled in the art will acknowledge, such as the defrosting of the air inlet of a turbine or gas compressor, the bleeding or expansion of vessels of compressed air or pressurized vapors, the blowing of vapor onto a surface to be cleaned, for example, and, in more general terms, the silent decompression of all gases or vapors at all temperatures.

The blowing device shown in FIG. 1 is installed, as a non-limiting example of the use of the invention, opposite the inlet cross-section 1 of a turbine or gas compressor (not shown). This inlet cross-section is normally equipped with one or more filters which, in wet or cold weather, can become clogged by ice, thereby cutting off the intake of air or at least reducing this. On this assumption, the air inlet then has to be unblocked by melting the ice, for example by blowing hot air into the filter.

For this purpose, the device of FIG. 1 comprises a source of hot air under pressure (not shown) feeding according to the arrow F a conduit 2 equipped with an adjusting valve 3. The conduit 2 in turn feeds a, for example, horizontal tubular manifold 4, on which are distributed uniformly and in parallel vertical racks 5, 5', etc. which each carry a plurality of air injecting and expanding silencers 6, 6', etc. according to the invention, distributed uniformly and oriented in such a way as to blow hot air over the entire extent of the air-inlet cross-section 1 of the turbine, so as thereby to ensure a uniform defrosting of the filter placed in this air inlet. The meshing of the silencers can advantageously be between 300×300 mm and 1000×1000 mm, depending on the dimensions of these.

With conventional air injectors instead of the silencers 6, 6', etc. according to the invention, such a low-pressure feed necessitates large-diameter and therefore costly racks 5, 5' if the flow speed and the noise in the pipes 2, 4, 5, 5', etc., especially in the bends or in "T"-junctions, have to be limited.

According to the present invention, the silencers 6, 6', etc., simultaneously performing the function of injectors, ensure a sonic silent expansion of the hot gases.

By means of the silencers according to the invention, a good distribution of the hot air in the air-inlet cross-section 1 is obtained, and it is possible to use, between the valve 3 and these silencers, small-diameter and therefore less costly pipes in which the pressure can be set, by the sizing of the passage cross-section of the throttle piece, at a value of between 5 and 15 bars, or more if the hot-air source so allows.

An injector silencer according to the invention will now be described in more detail with reference to FIG. 2 of the drawing which illustrates such a silencer in longitudinal section.

This essentially comprises a cylindrical tubular casing 7 closed at a first end by a throttle piece 8 and at a second end by a disk 9. The first end of this tubular casing is mounted in a mounting member 10 taking the form of a connector for fastening the silencer to a source of supply of gaseous fluid (not shown in FIG. 2). The connector 10 is fastened to the source by screwing or welding, to ensure communication between the source and the casing 7 of the silencer via the throttle piece 8. The latter bears on an annular shoulder 11 formed in the bore 12 of this connector which receives the adjacent end of the tubular casing 7. The connector 10 can be a commercial connector produced by lathe-turning or forging and has a thread for fastening the casing 7. The latter could also be welded to this connector. The other end of the casing is pierced with ports 13, 13', 13'' etc. distributed uniformly around the casing in the vicinity of the disk 9. The disk 9, fastened to the casing 7 by welding or screwing, can itself be pierced with ports. The cumulative area of all these ports is preferably in a ratio of 5 to 40 with the open area of the throttle piece 8.

According to a preferred embodiment of the invention, the throttle piece takes the form of a circular plate pierced with holes of the same diameter and uniformly distributed. This plate can be produced by the punching of a perforated metal sheet or by drilling. Its thickness is a function of the pressure in the rack 5 and of its diameter.

An essential characteristic of this plate 8 is that the cumulative total S2 of the cross-sections of these holes must be reduced in relation to the inlet cross-section S1 of the connector 10, so as to ensure a sonic flow of the gas at the entrance to the casing 7, whilst at the same time maintaining the same mass flow rate and a subsonic flow of the said gas in the pipes upstream of the device according to the invention, for a purpose which will appear later.

An essential characteristic of the silencer according to the invention, linked to the presence of shock waves downstream of the plate 8, is that the tubular casing 7 is filed completely, from the perforated plate 8 to the disk 9, with a packing 14 of fine metal wire (of less than 1 mm) of the closely wound knitted or woven fabric type. The length L of the packing must not be less than 20 mm for a casing 7 of small diameter and must, if possible, be between 20 and 300 mm, whatever the diameter of the casing. The porosity of such a knitted or woven fabric is higher than 80%.

The functioning of the silencer according to the invention then takes place as follows. The gas entering the casing 7 experiences a sonic expansion in the region of the plate 8, and the metal-wire packing 14 then reduces the noise of the expansion by stabilizing and breaking down the shock waves and by making the flow uniform. The packing, because it covers the ports 13, 13', 13'', etc. internally, also reduces the outward emission of noises generated by the passage of the gas through these ports. The presence of a sonic flow prevents the noises from passing back in the upstream direction and therefore into the rest of the installation. In addition, the effect of the increase of pressure in the installation attributable to the throttle piece is, for the same mass flow rate, to reduce the speed of the fluid and therefore the noise in the feed system. Downstream of the plate 8, the flow takes place at a low speed and low pressure, and therefore the tubular casing 7 is not subjected to high internal pressures.

Other materials could be selected to form the packing 14, for example a metal sponge with open cells of a porosity higher than 50%. In general terms, it is expedient if this material exhibits high mechanical resistance to the pressure generated by the gas which is entered through the holes of the perforated plate 8, so as not to be forced towards the other end of the casing and so as to continue to fill this completely. In this respect, tests have shown that the knitted metal fabric designated by G 270, stainless 304 L, embossed, double and closely wound, in the catalogues of Messrs. GANTOIS gives excellent results.

The silencer according to the invention is suitable for production in all diameters at low cost by means of components, connector, tube, etc., found in the trade. It can be completely metallic, being made of steel or stainless steel, and withstands high pressures, the upstream pressure being exerted only on the piece 8. It can also withstand high temperatures if it is produced from refractory stainless steel, including the knitted metal fabric. By providing a fastening by screwing, it can assume the nature of a removable and interchangeable cartridge.

By means of the invention, low speeds are established in the gas-flow pipes upstream of the silencer, the pressure then being high, the silencer making it possible to obtain a reduction of 25 to 45 dB of the noise which would be generated as a result of a direct sonic expansion into the open air via the cross-section S2.

The sonic silencer according to the invention moreover forms a screen against the rising of noise in the upstream direction in the feed piping. As a result of the invention and because of the low speeds of the fluid in the feed system, it is possible for the adjusting valve to be replaced by a less costly all-or-nothing valve or by a plurality of valves in parallel if a plurality of operating flow rates are necessary.

Furthermore, the characteristics of porosity, cohesion and elasticity of the packing are combined to ensure an effective unclogging of the latter under the effect of the agitation caused by the shock waves which are propagated in the silencer according to the invention.

We claim:

1. Silencer for expansion of a gaseous fluid, comprising a member for mounting the silencer on a fluid source and a casing having a first end covered by a throttle piece pierced with holes of cumulative area (S2) and carried by said member so as to communicate internally with the fluid source, said casing having a second end distant from the first end pierced with ports for the fluid admitted into the casing to pass into an outside medium, a packing of metal wire completely filling a space within the casing from the throttle piece to the second end of said casing, said packing overlapping the ports pierced in said second end of the casing, wherein the cumulative area (S2) of the holes of the throttle piece is chosen such that the flow through the throttle piece is increased from a subsonic speed to a sonic speed, whilst the flow through the ports is subsonic, and wherein the cumulative area of the ports cut out in the second end of the casing and the area left for the passage of the fluid in the throttle piece are in a ratio higher than 5.

2. Silencer according to claim 1 wherein the throttle piece consists of a plate having a uniform distribution of holes of identical dimensions.

3. Silencer according to claim 1 wherein the metal-wire packing consists of a tightly wound roll of a knitted fabric of metal wire.

4. Silencer according to claim 1 wherein the metal-wire packing consists of a tightly wound roll of a woven fabric of metal

5. Silencer according to claim 1 wherein the metal-wire packing is replaced by a metal sponge with open cells.

6. Silencer according to claim wherein the packing has a porosity higher than 50%.

7. Silencer according to claim 1 wherein the casing is a cylindrical tube.

8. Device for blowing a gaseous fluid onto an extensive surface comprising a plurality of parallel racks mounted on a common manifold which is connected to a source of a gaseous fluid, each rack carrying a plurality of fluid silencers uniformly distributed and oriented in such a way that the gaseous fluid is uniformly distributed over the surface to be treated by blowing, each of said silencers comprising a casing having a first end covered by a throttle piece pierced with holes of cumulative area (S2) and carried by said member so as to communicate internally with the fluid source, said casing having a second end distant from the first end pierced with ports for the fluid admitted into the casing to pass into an outside medium, a packing a of metal wire completely filling a space within the casing from the throttle piece to the second end of said casing, said packing overlapping the ports pierced in said second end of the casing, wherein the cumulative area (S2) of the holes of the throttle piece is chosen such that the flow through the throttle piece is increased from a subsonic speed to a sonic speed, whilst the flow through the ports is subsonic, and wherein the cumulative area of the ports cut out in the second end of the casing and the area left for the passage of the fluid in the throttle piece are in a ratio higher than 5.

* * * * *